US005115222A

United States Patent [19]

Peralta et al.

[11] Patent Number: 5,115,222

[45] Date of Patent: May 19, 1992

[54] ALARM TO DETECT ACCIDENTAL SUDDEN OR SLOW FALLS FROM CHILDREN INTO SWIMMING POOLS

[76] Inventors: Joaquin O. Peralta, Constitucion 339 1st Fl. "E" ; Rafael H. Martinez, Belgrano 159, 4300 La Banda, both of Santiago del Estero, Argentina

[21] Appl. No.: 528,037

[22] Filed: May 23, 1990

[30] Foreign Application Priority Data

May 24, 1989 [AR] Argentina ..... 314001

[51] Int. Cl.[5] ..... G08B 23/00

[52] U.S. Cl. ..... 340/573; 340/566; 340/595; 340/619; 340/625

[58] Field of Search ..... 340/573, 602, 618, 619, 340/623-625, 566, 555, 584, 595, 599, 606, 611, 626; 324/664, 694

[56] References Cited

U.S. PATENT DOCUMENTS

| | | | |
|---|---|---|---|
| 4,017,842 | 4/1977 | Vineyard | 340/625 X |
| 4,029,920 | 6/1977 | Odell | 340/625 X |
| 4,069,405 | 1/1978 | Fima | 340/624 X |
| 4,080,985 | 3/1978 | Eagle | 340/624 X |
| 4,533,907 | 8/1985 | Thatcher | 340/565 |
| 4,571,579 | 2/1986 | Woolley | 340/566 |
| 4,771,272 | 9/1988 | Barnes | 340/624 |

*Primary Examiner*—Jin F. Ng
*Assistant Examiner*—Thomas J. Mullen, Jr.
*Attorney, Agent, or Firm*—Bruce L. Adams; Van C. Wilks

[57] ABSTRACT

The disclosure pertains to a device for detecting sudden or slow immersion of a body into a swimming pool. More specifically, the invention pertains to a device to detect the accidental immersion of children into swimming pools. In a first embodiment, a first chamber is submerged in the water, and communicates with the water through tubes, so that disturbances in the water not caused by the immersion of a body are damped. A second chamber is in communication with the first chamber and has a sensor disposed inside it. The immersion of a body in the water causes a variation in the air mass contained in the chambers, which is sensed by the sensor which then sounds an alarm.

9 Claims, 2 Drawing Sheets

ALARM TO DETECT ACCIDENTAL SUDDEN OR SLOW FALLS FROM CHILDREN INTO SWIMMING POOLS

BACKGROUND OF THE INVENTION

This invention refers to a device for detecting sudden or slow accidental immersion of a body into a swimming pool, specifically to detect the accidental immersion of children into swimming-pools. Such an event sometimes remains unnoticed resulting in unfortunate consequences such as week-end residences, villas or clubs without guarding.

It is not actually known in practice of any kind of device or alarm for detecting this kind of accidental fall. There fore, it is important to create a means which may be capable of warning of any unnoticed sudden or slow immersion of a body into a liquid medium. In view of the above, this invention comprises a device which can be applied on any swimming pool area, thus facilitating the detection of any slow or fast immersion of a body, the volume of which may be equal to or exceed that of an infant's, that is, approximately 6 or 8 $dm^3$.

This device generates a response based on detecting means of different physical effects such as the relative humidity variation of air impelled from within a chamber in communication with the liquid medium in the swimming pool, air thermal variations and tension variations of a semi immersed object fixed to the swimming-pool by effect of such object immersion in the swimming-pool to cause a piezo-electric or birefringent effect. The operating principle of this device is based on a response to the immersion of a body into the liquid mass in the swimming pool which causes a rise in the water level. This small level variation in a first embodiment of the invention, is separated from unwanted permanent and harmonic variations and from the surface liquid by damping the superficial waves so that the liquid may run into a small chamber in communication with the liquid mass. There, a rise in the water level as a consequence of the immersed body to be detected, causes an air flow towards a receptacle, opened to the atmospheric pressure and in which sensor devices are set of psychrometric properties of the air impelled by the rise in the liquid level in the chamber. The change and/or rate of change of air relative humidity is detected by a sensor placed in the receptacle which, in response to the humidity variation, unbalances an impedance bridge which by means of circuit components allows the generation of an electrical pulse activating an alarm. The receptacle may also have a second sensor of psychrometric properties consisting of a metal and vegetal fiber plate, whose mechanical properties are extremely sensitive to small variations of relative humidity and temperature. A variation in the sensor properties allows a variation in the intensity of a light coming from a light source which reaches a phototransistor. In a second embodiment of this invention, the chamber—in communication with the liquid medium of the swimming pool—is connected by means of a tube to a small receptacle in which a heater, such as a resistor, and a thermic sensor are placed, the receptacle being provided with an air drain. When a body falls into the swimming pool at this step, the rise in the water level of the chamber causes an air flow which is impelled towards the tube, thus changing the stationary thermal regime conditions. This temperature variation is detected by the sensor to generate a signal which, if in excess of a given value corresponding to a value given by the body volume, causes an alarm to be activated. In a third embodiment of the invention, the device is provided with a bottomless receptacle partially submerged in the liquid mass in the swimming-pool in which a floater is confined, and articulated to a wall of the confined place adjacent to the receptacle where a plate is fixed with which an arm of the floater forms a capacitor, whose capacitance variation is caused by a body immersion into the swimming-pool and it is used to generate a signal, which after being processed activates an alarm as described previously.

In a fourth embodiment, the device is furnished with a floater covering a certain area in the water and fixed with respect to a wall of the swimming pool. The floater is related to a piezo-electric crystal and when the floater is affected by a water level rise due to a body immersion, it transmits a stress on said crystal causing a signal which is then amplified and processed to activate an alarm as in previous steps. Finally, in a fifth embodiment of this invention, the floater arm, as in the previous example, is connected to the end of a non-birefringent plastic plate fixed by its opposite end to a wall of the swimming pool. The floater transmits a tension in response to a body immersion into the swimming pool so that the plate acquires birefringent properties by the tension effect. Therefore, this invention refers to a device for detecting accidental falls, whether sudden or slow, into swimming pools, specifically those of children.

The invention is characterized in that it is provided with devices sensitive to the level variation of a given value in the liquid mass of a swimming-pool, composed of a partially submerged device; the said device being provided with responsive means to said level variation in correspondence to a detecting device capable of generating a signal whose value corresponds to the detected body volume; the output of this detector being connected to a signal generating circuit which causes an alarm activation in response to the output signal of the detector. The invention comprises also other supplementary parts which will be further referred to in this description.

BRIEF DESCRIPTION OF THE DRAWING

In order that this invention can be clearly understood and be easily put into operation, the following drawings are annexed.

Figure 6:
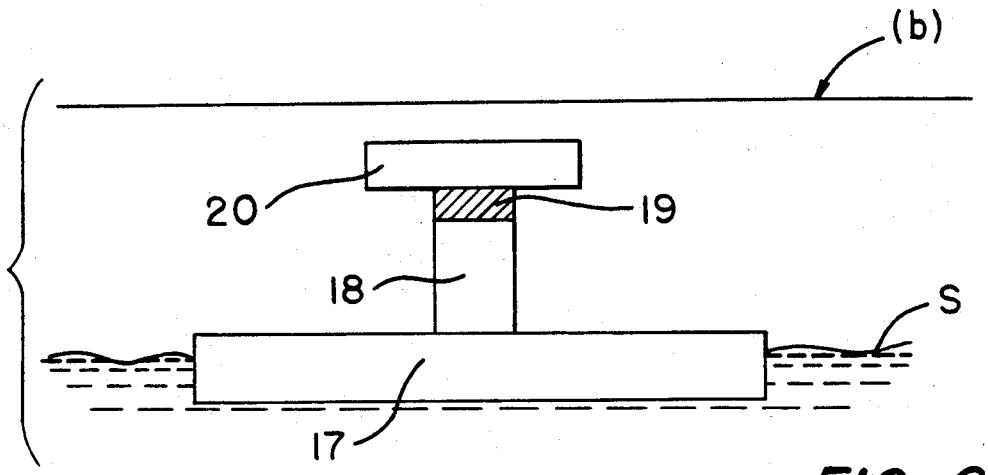
FIG. 6 shows a fourth embodiment of the device provided with a floater that induces a tension in a piezoelectric crystal.
Figure 8:
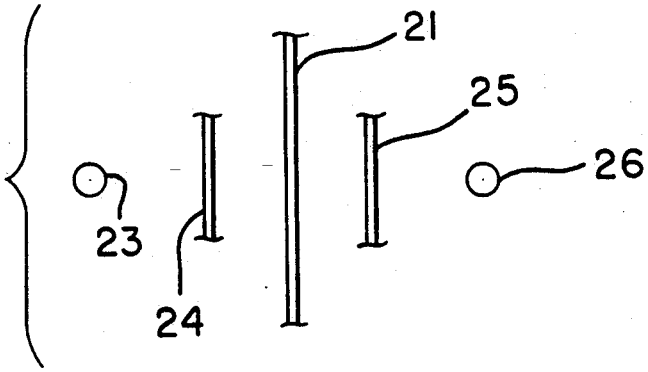

Finally, FIG. 8 provides a drawing of a sensor as used in FIG. 6.

DETAILED DESCRIPTION OF THE DRAWINGS

Figure 1:
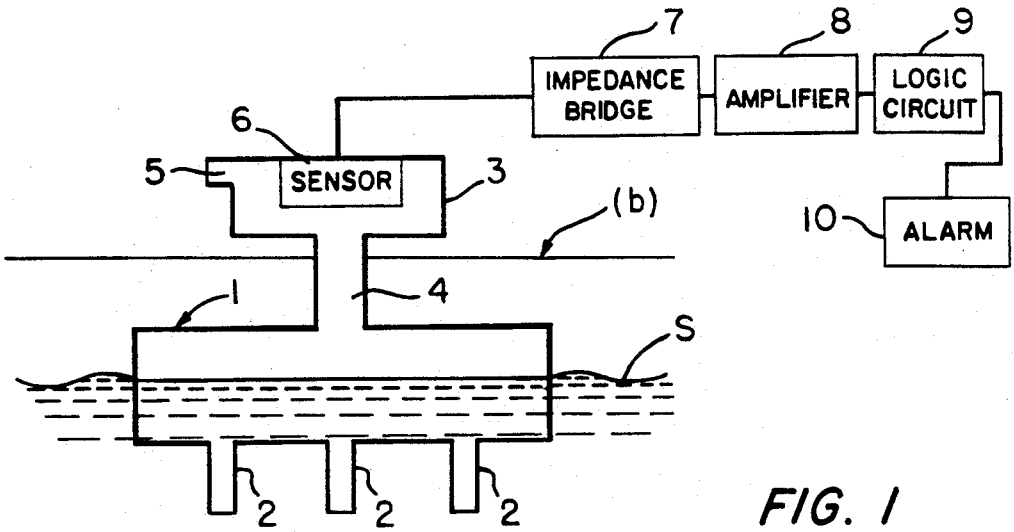
FIG. 1 shows a first embodiment of the device in which a chamber is communicated with the liquid medium in the swimming pool.
Figure 2:
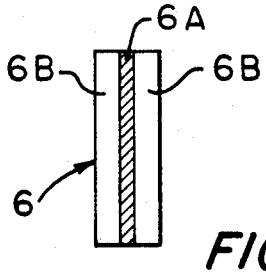
FIGS. 2 and 3 show, respectively, sensors being part of the device in FIG. 1.
Figure 3:
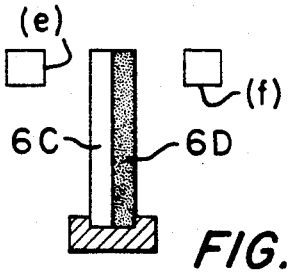
Figure 5:
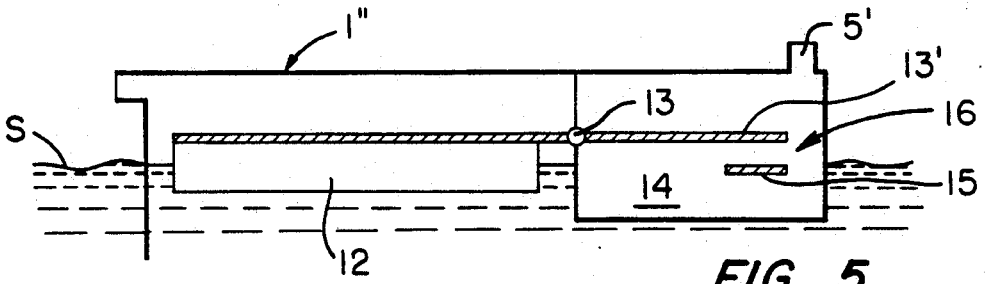
FIG. 5 shows a third embodiment of the invention consisting of a floater with a capacitive sensor for detecting a body fall.
Figure 4:
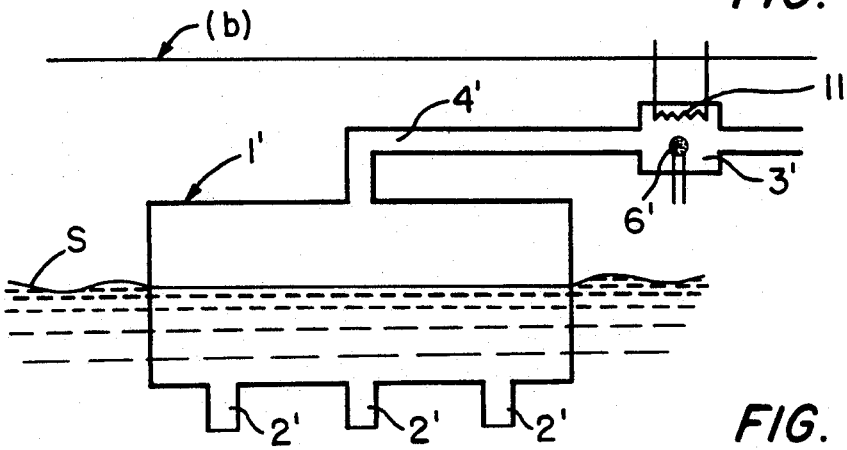
FIG. 4 shows a second embodiment of the device in which, similarly, as in FIG. 1, a chamber is used for air flow.
Figure 7:
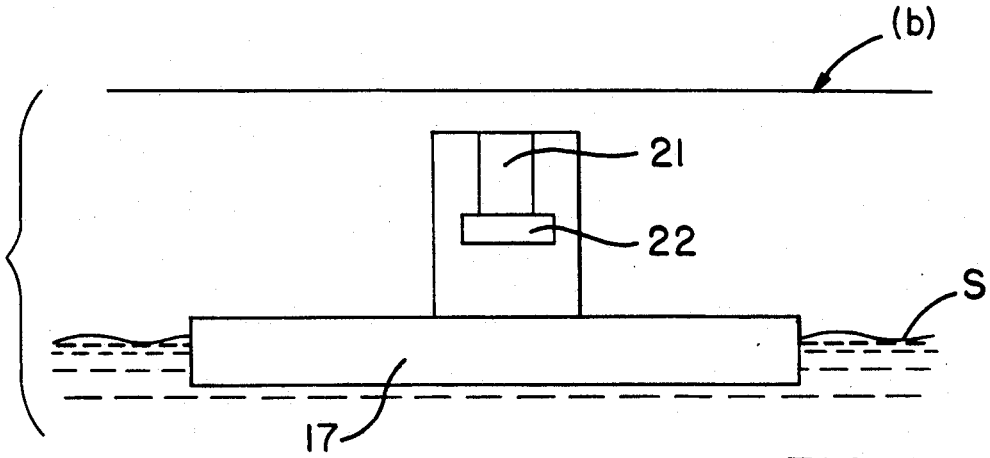
FIG. 7 shows a fifth embodiment of the invention with a floater for inducing a tension in a birefringent plastic plate.

In all the above-mentioned figures the same reference numbers show equal or corresponding parts. According to what is shown in the drawings and specifically in FIGS. 1 and 3, where a first embodiment of the inventive device is shown, the said device consists of a chamber 1 fixed to the swimming pool wall (p) and partially submerged in the liquid mass of it. Chamber 1 in its bottom is composed of a series of tubes 2 or ducts which communicate the chamber inner part with the swimming-pool, so that in said chamber the water level equals that of the surface 5 of the water in the swimming pool allowing tubes 2 to separate the unwanted, permanent and harmonic variations of the liquid mass from the level variations caused by a body immersion in the swimming pool. Chamber 1 is in communication with a second chamber or receptacle 3 by means of a duct 4, receptacle 3 being communicated with the atmosphere by means of an opening 5. Inside receptacle 3, a psychrometric or mechanic sensor 6 is placed for detecting water level variations, the output of sensor 6 being connected, for instance, to an impedance bridge 7 with an output connected to a differential amplifier 8, whose output signal is fed by a logical circuit 9, which provides an activating signal to an alarm 10 such as an electric bell, buzzer, light, telephone, etc. FIG. 2 shows an example of the psychrometric sensor 6 consisting of a resistor-capacitive transducer which includes aluminum oxide 6A between metallic layers 6B. FIG. 3 shows another example of the psychrometric sensor. In this case, it is composed of a plate made of metal 6C and vegetal fiber 6D, whose mechanical properties are extremely sensitive to small relative humidity variations and to temperature, thus allowing to change the intensity of a light source (1C) reaching a phototransistor (f) whose signal is processed by a logic circuit not shown in the drawing to activate alarm 10. The operation of the device of FIG. 1 responds to a water level variation inside chamber 1 in response to a body immersion which causes an air flow towards receptacle 3 where sensor 6 is placed. The impelled air mixes with the air in receptacle 3 causing a combination of psychrometric properties different to those initially found. This change and/or rate of change in the relative humidity is detected by sensor 6 generating a signal which unbalances the impedance bridge 7 of the alarm activating circuit 10. As previously stated, the device above described may use different sensors among which mechanical sensors allow circuits for different alarms to be activated. FIG. 4 shows a second view of the device which consists, as in the previous one, of a partially submerged chamber 1' in the swimming-pool liquid medium provided with tube 2' in its bottom for water flow and fixed to the swimming-pool wall (p). The water in chamber 1' reaches the swimming-pool water level limiting a certain space filled with air which is in communication with a tube or duct 4' ending in a small receptacle 3' in communication with the atmosphere. In receptacle 3' there is a thermal sensor 6' and a heating resistance element 11 close to sensor 6'; the said sensor defining the stationary thermal conditions of the air therein. When the air is moved as a consequence of a water level variation caused by the immersion of a given body volume, the thermal conditions through duct 4' are modified. This change in temperature is detected by sensor 6', as in the previous case, and if the generated signal exceeds a given value which corresponds to a given value of volume immersed in the swimming-pool. it activates alarm 10. FIG. 5 shows a third view of the invention in which chamber 1'' is opened in its lower part and is partially submerged in the swimming-pool. to define a confined place for floater 12 which is articulated on an axis 13 on a side wall of chamber 1'' by means of an arm 13' extending into a confined place or second chamber 14, tightly closed and adjacent to chamber 1'' which is provided with an opening 5' in communication with the atmosphere. Arm 13' of floater 12 is metallic and its extreme end is confronted to a metal plate 15 in order to form a capacitor, i.e., a mechanical sensor 16. The immersion of a body of a given volume in the swimming-pool results in a movement of floater 12 in response to a water level variation within chamber 1''. This causes arm 13' to be articulated causing a variation in the sensor capacitance located in confined place 14; as the sensor 16 is part of a circuit similar to that shown in FIG. 1, the signal activates an alarm. In FIG. 6, the device is composed of a floater 17 which covers a given area of the swimming-pool water and which is secured to a piezo-electric crystal 19 by a link 18. The piezo electric crystal is fixed to a swimming-pool wall by means of a holder 20. In this fourth version of the device when the swimming-pool water level rises by effect of a body immersion, floater 17 transmits a stress to the piezo-electric crystal 19 generating an electric pulse which allows the activation of alarm 10. Finally, in FIG. 7 another version of the device is shown in which floater 17 is linked to the end of a plastic plate 21, the opposite end of which is securely fixed to a holder 22 fixed to the swimming pool wall. Plate 21 is non birefringent and as a response to floater 17 movement, it acquires birefringent properties by effect of the tension to which it is subjected so that a light source 23 (FIG. 8) and a polarizer 24 which is confronted to plate 21, the opposite side of which is confronted to an analyzer 25 and to a phototransistor 26 which causes an activation signal for alarm 10. The invention as above described can be clearly understood and requires no further explanations for experts on the matter.

The nature and operating procedure of this invention having been so specifically described results in that what is hereby claimed as exclusive ownership and invention is as follows:

1. An apparatus for detecting full or partial immersion of an object in a confined body of water, comprising: a first chamber having a plurality of openings submergible in a body of water during use of the apparatus to allow the water to enter into the first chamber and having a first hole disposed above the level of water in the first chamber; a second chamber having a second hole in communication with the first hole of the first chamber; and sensing means disposed in the second chamber for sensing a variation in air contained in the second chamber caused by the immersion of an object in the body of water and generating an alarm in response thereto.

2. An apparatus according to claim 1, wherein the plurality of openings are defined by a plurality of hollow tubes each having a first end integral with the first chamber and a second end submerged in the water.

3. An apparatus according to claim 1, wherein the sensing means comprises a psychrometric sensor having a resistive capacitive transducer comprised of aluminum oxide.

4. An apparatus according to claim 1, wherein the sensing means comprises a psychrometric sensor having a humidity and temperature sensitive plate member disposed between a light source and a phototransistor such that the variation in the air causes a change in the light-transmittance of the plate member.

5. An apparatus according to claim 4, wherein the plate member is comprised of a metal and a vegetal fiber.

6. An apparatus according to claim 1, wherein the sensing means includes a thermal sensor and a heat generating resistor disposed in proximity therewith; and the second chamber has a third hole open to the atmosphere.

7. An apparatus for detecting full or partial immersion of an object in a confined body of water, comprising: a first chamber at least partially submergible in a body of water during use of the apparatus and having an opening for communication with the water; a second chamber; a float member disposed within the first chamber; an arm member, integral with the float member, pivotally supported and extending into the second chamber such that movement of the float causes by the immersion in the water of the object causes the arm to move within the second chamber; and sensing means for sensing the movement of the arm.

8. An apparatus according to claim 7, wherein the sensing means comprises a capacitive sensor having a first metal plate disposed on the arm and a second metal plate supported within the second chamber.

9. An apparatus for detecting full or partial immersion of an object in a confined body of water, comprising: a first chamber mountable in a confined body of water during use of the apparatus and having at least one opening therein to allow the water to flow into the first chamber to a level corresponding to that of the body of water; a second chamber disposed adjacent the first chamber and being filled with air; means defining a passage communicating the interior of the first chamber above the level of water therein with the interior of the second chamber whereby immersion of an object in the body of water raises the water level in the first chamber thereby displacing air from the first chamber through the passage into the second chamber; and sensing means for sensing a change in a predetermined property of the air in the second chamber due to displacement of air from the first chamber to the second chamber and for producing in response thereto an alarm signal.

* * * * *